US007228780B1

(12) United States Patent
Thomele

(10) Patent No.: US 7,228,780 B1
(45) Date of Patent: Jun. 12, 2007

(54) HANDGUN WITH TWO-SIDED BREECHBLOCK MECHANISM

(75) Inventor: Adrian Thomele, Holtsee (DE)

(73) Assignee: S.A.T. Swiss Arms Technology AG, Neuhausen (CH)

( * ) Notice: Subject to any disclaimer, the term of this patent is extended or adjusted under 35 U.S.C. 154(b) by 18 days.

(21) Appl. No.: 11/059,629

(22) Filed: Feb. 16, 2005

(30) Foreign Application Priority Data

Feb. 20, 2004 (DE) ..... 20 2004 002 674 U

(51) Int. Cl.
*F41A 3/00* (2006.01)

(52) U.S. Cl. ..... 89/190; 42/70.01

(58) Field of Classification Search ..... 89/24, 89/181, 190, 199; 42/70.01, 70.02
See application file for complete search history.

(56) References Cited

U.S. PATENT DOCUMENTS 2,664,786 A * 1/1954 Bonifacio ..... 89/163
3,492,748 A * 2/1970 Swenson ..... 42/70.01
4,414,769 A * 11/1983 Mueschke ..... 42/70.01
4,481,863 A * 11/1984 Zanner et al. ..... 89/138
4,607,563 A 8/1986 Meyer et al.
4,681,020 A * 7/1987 Polanecky ..... 89/138
4,915,011 A * 4/1990 Smith ..... 89/176
5,212,327 A * 5/1993 Schuemann ..... 42/70.01
5,903,994 A * 5/1999 Tange ..... 42/70.01
6,588,136 B2 * 7/2003 Baker et al. ..... 42/70.05

* cited by examiner

*Primary Examiner*—Michael J. Carone
*Assistant Examiner*—Bret Hayes
(74) *Attorney, Agent, or Firm*—Martin Fleit; Paul D. Bianco; Fleit Kain Gibbons Gutman Bongini & Bianco P.L.

(57) ABSTRACT

A handgun, particularly an automatic pistol, with a grip piece, a breech that can be longitudinally displaced relative to the grip piece, and a breechblock mechanism that can be actuated on both sides and serves for holding the breech in its open position. The breechblock mechanism has a breechblock lever that is realized in the form of a one-piece punched and bent part and has two lateral parts that are integrally connected to one another by a crosspiece, as well as operating parts that are integrally connected to the respective lateral parts.

15 Claims, 3 Drawing Sheets

HANDGUN WITH TWO-SIDED BREECHBLOCK MECHANISM

The present application claims the benefit of the following two provisional patent applications, which are each incorporated herein by reference: (i) U.S. Provisional Patent Application Ser. No. 60/546,468 entitled "METHODS AND APPARATUS FOR CONSTRUCTING A POWER SUPPLY CAPABLE OF DUAL FREQUENCY INPUT", filed Feb. 23, 2004; (ii) U.S. Provisional Patent Application Ser. No. 60/547,574 entitled—METHODS AND APPARATUS FOR CONSTRUCTING A DUAL FREQUENCY REGULATED POWER SUPPLY filed Feb. 26, 2003.

BACKGROUND OF THE INVENTION

1. Field of the Invention
2. Prior Art

A handgun of this type with a breechblock mechanism that can be actuated on both sides is known from DE 100 08 979 A1. In this case, the breechblock consists of a first pivot lever that is provided with a catch element and arranged on one side of the weapon, wherein this first pivot lever is non-rotatably fitted to a pivot lever shaft that laterally extends through the weapon to the other side. A second pivot lever provided on the other side of the weapon is detachably connected to the free end of the pivot lever shaft. However, the manufacture of such a multi-piece breechblock mechanism is quite complicated. In order to install and remove this breechblock mechanism, both pivot levers must be assembled or disassembled, which is time- and labor-intensive. In addition, suitable measures must be taken in order to ensure that both pivot levers are held together in the assembled state.

SUMMARY OF THE INVENTION

The invention is based on the objective of developing a handgun of the initially mentioned type with a breechblock mechanism that can be inexpensively manufactured and easily installed.

This objective is attained with a handgun with the characteristics of claim 1. Practical additional developments and advantageous embodiments of the invention form the objects of the dependent claims.

One significant advantage of the handgun according to the invention can be seen in the fact that the breechblock lever can be manufactured quite easily from a sheet metal by means of punching and bending processes, wherein the breechblock lever can also be easily installed. Complicated manufacturing and installation steps are not required. Another advantage of the invention is that the elimination of any play between the two operating elements results in improved accuracy.

In one particularly practical embodiment of the invention, the two lateral parts are bent upwards relative to the crosspiece. The two respective lateral parts contain front sections that project forwards relative to the crosspiece and are provided with aligned through-openings for a pivot pin.

Holding and operating parts that are respectively bent outwards and downwards preferably are integrally connected to the sections of the two lateral parts that project rearwards relative to the crosspiece, wherein at least one of the holding parts is designed for engaging into a lateral slot of the breech.

A tab that causes the breechblock lever to be pressed into a raised locking position by the feeder mechanism of the inserted magazine is integrally connected to one of the lateral parts.

BRIEF DESCRIPTION OF THE DRAWINGS

Other particularities and advantages of the invention are described below with reference to a preferred embodiment that is illustrated in the drawings in which.

DETAILED DESCRIPTION OF PREFERRED EMBODIMENTS OF THE INVENTION

Figure 1A:
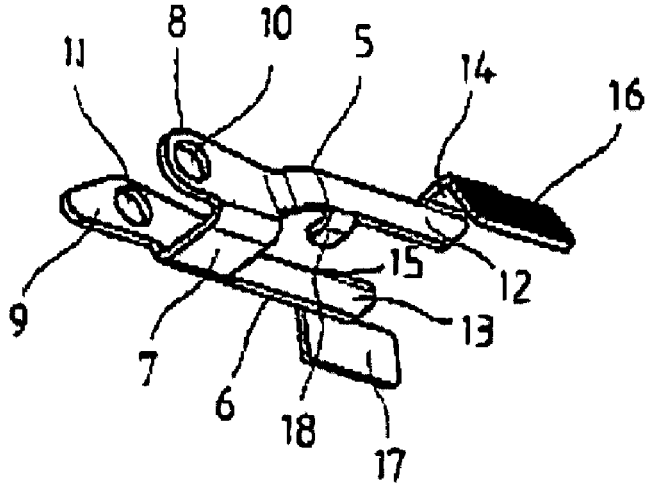
FIGS. 1*a* and 1*b* show a breechblock lever in two perspective representations.
Figure 1B:
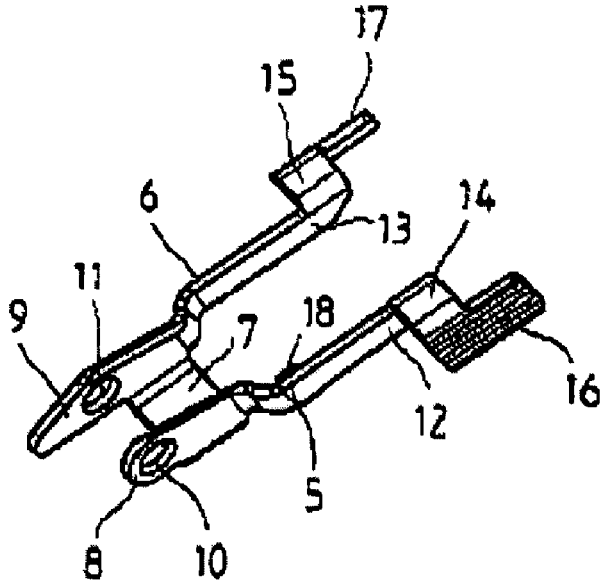
Figure 2:
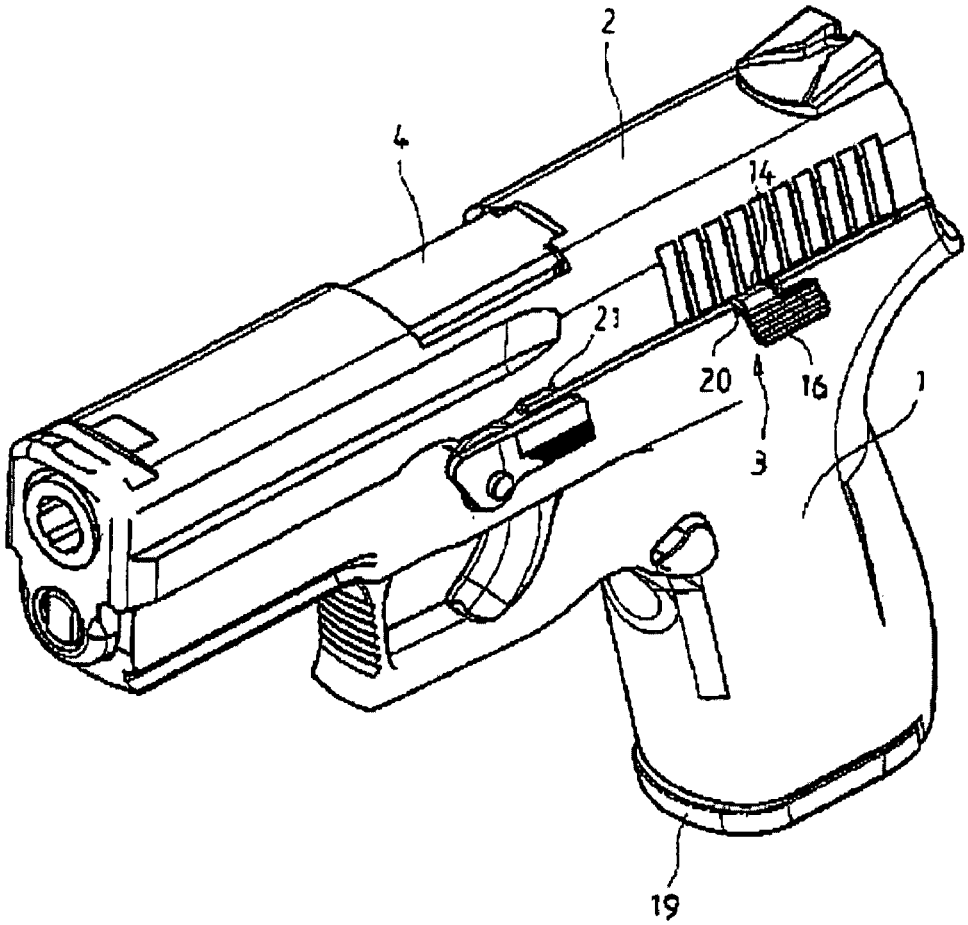
FIG. 2 shows a pistol with the breechblock lever shown in FIGS. 1*a* and 1*b*, wherein the breech of the pistol is in the closed position.
Figure 3:
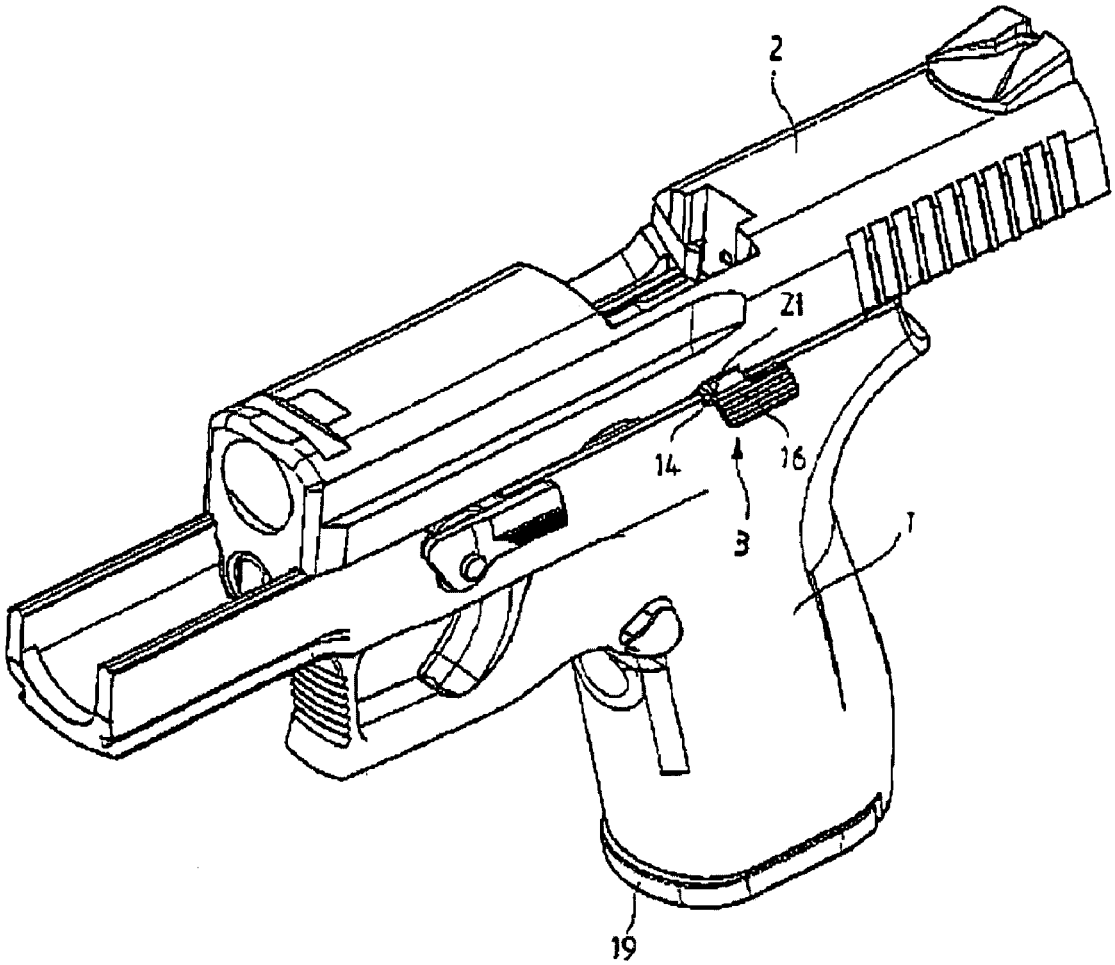
FIG. 3 shows a pistol with the breechblock lever shown in FIGS. 1*a* and 1*b*, wherein the breech of the pistol is in the open position.

The pistol that is schematically illustrated in FIGS. 2 and 3 contains a grip piece 1 that is made of plastic or metal and a breech 2 that can be longitudinally displaced relative to the grip piece 1. This breech can be held in an open position by the breechblock lever 3 that is illustrated separately in FIGS. 1*a* and 1*b*. A barrel 4 is conventionally arranged within the breech 2.

According to FIGS. 1*a* and 1*b*, the breechblock lever 3 consists of two flat lateral parts 5 and 6 that are separated from one another and connected by a lower crosspiece 7. The two respective lateral parts 5 and 6 contain front sections 8 and 9 that project forwards relative to the crosspiece 7 and are provided with aligned circular through-openings 10 and 11 for a shaft journal or a pivot pin. The breechblock lever 3 is pivotably arranged in an insert that can be installed into the grip piece 1 with the aid of the lateral through-openings 10 and 11 and the (not-shown) pivot pin. The sections 12 and 13 of the two lateral parts 5 and 6 that project rearwards relative to the crosspiece 7 are perpendicularly bent outwards and respectively contain outwardly projecting arms with perpendicularly bent holding parts 14 and 15 and downwardly angled operating parts 16 and 17. A knurling is embossed into the outer side of the operating parts 16 and 17. An inwardly bent tab 18 is provided on the front lateral part 5 in FIG. 1, wherein said tab engages with a feed mechanism of a magazine 19 inserted into the grip piece 1 in order to raise the breechblock lever 3. The breechblock lever 3 shown in the figures can be easily manufactured in the form of a one-piece punched and bent part.

a. The breechblock lever 3 is arranged on an insert within the grip piece 1 in such a way that it can be pivoted between the lower position shown in FIG. 2 and the upper position shown in FIG. 3. In the lower position, the holding part 14 of the breechblock lever 3 engages into a lateral recess 20 on the upper edge of the grip piece 1. In this position of the breechblock lever 3, the breech 2 is able to freely move rearwards. However, once the last cartridge is fired, the breechblock lever 3 is pressed upwards by the (not-shown) spring-loaded feed mechanism of the magazine 19 that engages with the tab 18. As the breech 2 is displaced rearwards, the holding part 14 of the breechblock lever 3 engages into a lateral slot 21 on the underside of the breech 2 so that it is held in the open position.

After removing the empty magazine and inserting a full magazine, the breechblock lever 3 can be pressed downwards with the thumb of the right or left hand, namely with the aid of the operating parts 16 and 17 that project from the right and left of the grip piece. This causes the holding part 14 to disengage from the lateral slot such that the pistol is once again ready to be fired.

What is claimed is:

1. A handgun, comprising:

a grip piece;

a breech longitudinally displaceable relative to the grip piece; and a breechblock mechanism including a one-piece breechblock lever positionable within the grip piece and having two lateral parts integrally connected together by a crosspiece, an operating part is connected to a first end section of each of the lateral parts, such that the breechblock mechanism can be actuated on opposite sides of the breech and serves for holding the breech in an open position, wherein the one-piece breechblock lever is formed of a one-piece punched and bent part.

2. A handgun according to claim 1, wherein the two lateral parts are bent upward relative to the crosspiece.

3. A handgun according to claim 1, wherein the two lateral parts each include a second end section opposite the first end section and projecting forward relative to the crosspiece, the second end sections each having an aligned through-openings for receiving a pivot pin therethrough.

4. A handgun according to claim 1, wherein the the first end sections project rearward relative to the crosspiece, and the operating parts are integrally connected to the first end sections.

5. A handgun according to claim 1, the breechblock mechanism further comprising a holding part integrally connected to at least one of the lateral parts, wherein the holding part engages a lateral slot of the breech when the breech is displaced in the open position.

6. A handgun according to claim 5, wherein the holding part is perpendicularly bent outwards relative to the two lateral parts.

7. A handgun according to claim 6, wherein the operating parts are bent downwards relative to holding parts.

8. A handgun according to claim 1, wherein a tab for raising the breechblock lever into a locking position is arranged on one of the lateral parts.

9. A handgun according to claim 1, wherein a knurling is embossed into an outer side of the operating parts.

10. An automatic pistol comprising:

a grip piece;

a breech longitudinally displaceable relative to the grip piece; and a one-piece breechblock lever including a holding part, wherein the breechblock lever is pivotally arranged in the grip piece such that the breechblock lever is pivotable between a lower position and an upper position, wherein in the lower position the holding part is positioned in a recess in the grip piece allowing the breech to move freely with respect to the grip piece, and wherein in the upper position the holding part engages the breech, locking the breech in an open position.

11. An automatic pistol as set forth in claim 10 further comprising a magazine removably positioned in the grip piece, wherein the breechblock lever is moved from the lower position to the upper position when a last cartridge is expelled from the magazine.

12. An automatic pistol as set forth in claim 11 wherein the breechblock lever is movable from the upper position to the lower position when the magazine is removed from the grip piece and replaced with a second magazine including a plurality of cartridges.

13. An automatic pistol as set forth in claim 10 wherein the breechblock lever includes a first operating part extending away from a first side of the grip piece and a second operating part extending away from a second side of the grip piece.

14. An automatic pistol as set forth in claim 13 wherein the first or second operating parts can be used to move the breechblock lever from the upper position to the lower position, unlocking the breech with respect to the grip piece.

15. An automatic pistol as set forth in claim 10 wherein the one-piece breechblock lever is a one-piece punched and bent part.

* * * * *